United States Patent [19]

Wetzels

[11] 4,063,906

[45] Dec. 20, 1977

[54] METHOD FOR GRINDING ELONGATED CYLINDRICAL WORKPIECES WHICH ARE ADVANCED DURING THE GRINDING OPERATION WHILE BEING ROTATED ABOUT THE LONGITUDINAL AXIS THEREOF

[75] Inventor: Walter Wetzels, Eynatten, Belgium

[73] Assignee: SCHUMAG Schumacher Metallwerke Gesellschaft mit beschränkter Haftung, Aachen, Germany

[21] Appl. No.: 713,571

[22] Filed: Aug. 11, 1976

[30] Foreign Application Priority Data

Aug. 21, 1975 Germany ..... 2537151

[51] Int. Cl.[2] ..... B24B 1/00

[52] U.S. Cl. ..... 51/289 R; 51/33 W; 51/49; 51/88; 51/103 TF

[58] Field of Search ..... 51/33 W, 38, 42, 49, 51/88, 103 TF, 103 R, 289 R

[56] References Cited

U.S. PATENT DOCUMENTS

| | | | |
|---|---|---|---|
| 2,127,210 | 8/1938 | Dunbar | 51/289 R |
| 3,079,741 | 3/1963 | Render | 51/289 R |
| 3,423,887 | 1/1969 | Strom | 51/289 R |
| 4,004,375 | 1/1977 | Wieck | 51/289 R X |

FOREIGN PATENT DOCUMENTS

| | | | |
|---|---|---|---|
| 805,988 | 6/1951 | Germany | 51/88 |
| 1,001,916 | 1/1957 | Germany | 51/88 |

*Primary Examiner*—Gary L. Smith
*Attorney, Agent, or Firm*—Herbert L. Lerner

[57] ABSTRACT

Method of grinding elongated, cylindrical workpieces in continuous operation in a grinding machine wherein the workpieces are advanced while they are rotated about their longitudinal axes includes exerting an oscillating grinding pressure transversely to the longitudinal axis of the workpiece, and adjusting the frequency of the oscillations to lie substantially in low-to-medium frequency range, outside the frequency ranges of resonant vibrations of parts of the workpiece and of the grinding machine; and device for carrying out the foregoing method.

16 Claims, 3 Drawing Figures

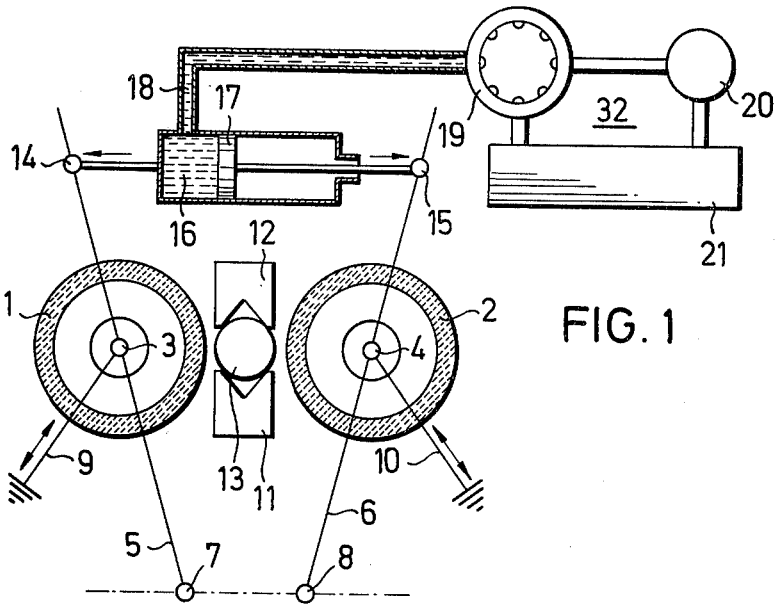
FIG. 1
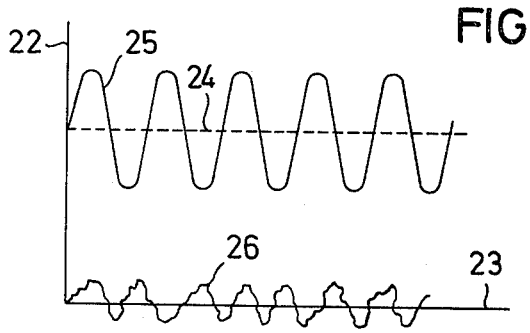
FIG. 2
FIG. 3
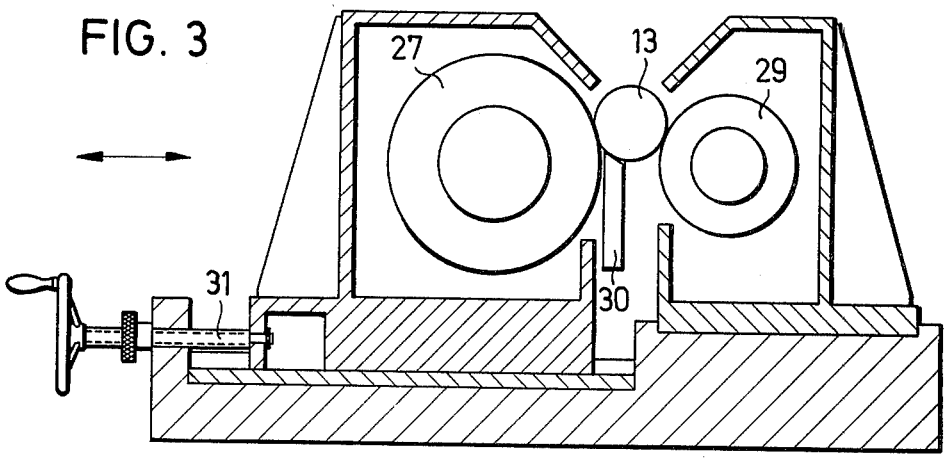

METHOD FOR GRINDING ELONGATED CYLINDRICAL WORKPIECES WHICH ARE ADVANCED DURING THE GRINDING OPERATION WHILE BEING ROTATED ABOUT THE LONGITUDINAL AXIS THEREOF

The invention relates to a method of grinding elongated cylindrical workpieces in continuous operation, the workpieces being advanced while being rotated about their longitudinal axis, and grinding pressure being exerted transversely to the longitudinal axis of the workpiece. The invention also relates to a device for implementing such a method.

It has been found that with heretofore known methods and devices of these general types, resonant vibrations are generated during grinding which produce undesirable markings on the workpiece. In the course thereof, the grinding wheels also become prematurely dull.

To avoid these shortcomings, the support bearings for the grinding wheels and the guide members for the workpieces have heretofore been made particularly sturdy and massive. In this manner, it has been possible to reduce the resonant vibrations and to slow the dulling of the grinding wheels.

Both in grinding between centers and in centerless grinding, undesirable resonant vibrations have also been observed. To nullify the effect of these resonant vibrations as much as possible, it has become known heretofore to work with artificially generated counter vibrations. For this purpose, the resonant vibrations are sensed or picked up by a pick-up or sensing and control device, and the counter-vibrations are brought to the same amplitude with and opposite phase to the respective amplitude and phase of the resonant vibrations. This is supposed to reduce the resulting vibrations. Unfortunately, however, it has been found that with these known measures the vibration reduction is only partially successful and the undesirable markings on the workpieces are unable to be avoided. When grinding in a continuous operation, additional difficulties are encountered, and the application of the aforementioned measures to grinding in a continuous operation has not heretofore become known.

Working with longitudinal vibrations in the ultrasonic range has furthermore become known for grinding between centers or centerless grinding. The application of this measure to workpieces which are to be ground in continuous operation would appear to be difficult and has not heretofore become known.

For grinding between centers and centerless grinding, it has further become known to apply longitudinal vibrations with relatively large amplitude in the low frequency range. It has also not been known heretofore to employ this measure for grinding in continuous operation. Tests that have been carried out have shown that, in grinding with continuous operation, this measure results in differences in diameter of the ground workpiece which recur periodically in the longitudinal direction thereof.

It is an object of the invention to provide a method of grinding elongated cylindrical workpieces in continuous operation of the foregoing type which will avoid the formation of undesirable markings on the workpiece and which will afford long service life of the grinding wheels. It is a further object of the invention, to provide such a method that will, at the same time, yield a particularly good surface with a high degree of roundness. It is a further object of the invention, to provide such a method that affords a high material removal and throughput velocity. It is yet another object of the invention, to provide such a method which affords improved measurement control, whereby the measurement and control data, which are picked up or sensed at the material of the workpiece continuously passing through the equipment in which the method is performed, are not falsified by resonant vibrations. It is yet a further object of the invention to provide a device for implementing the foregoing method in an advantageous manner.

With the foregoing and other objects in view, there is provided, in accordance with the invention, a method of grinding elongated cylindrical workpieces in continuous operation in a grinding machine wherein the workpieces are advanced while they are rotated about the longitudinal axes thereof which comprises exerting an oscillating grinding pressure transversely to the longitudinal axis of the workpiece and adjusting the frequency of the oscillations to lie substantially in low-to-medium frequency range outside the frequency ranges by resonant vibrations of parts of the workpiece and/or the grinding machine employing the method.

The invention furthermore includes the feature of pulsating an hydraulic medium so as to exert the oscillating grinding pressure.

It has been found surprisingly that using the method of this invention, the foregoing problems have virtually completely been solved and the foregoing objects attained. In contrast to the aforedescribed heretofore known methods which utilize counter-vibrations which are in phase opposition to the resonant vibrations, it is, in fact, necessary according to the invention that the pulsations have a frequency which is outside the frequency ranges of the resonant vibrations. The resonant vibrations are not caused to disappear thereby. As has been ascertained by tests, however, they no longer have any adverse effect on the condition of the surface and the roundness of the workpiece and the life of the grinding wheels.

The method according to the invention cannot be compared with the aforedescribed heretofore known method for the simple reason that it relates to grinding in continuous operation, while the heretofore known aforementioned methods of this general type all relate to grinding between centers or centerless grinding. In addition, the pulsations in the method according to the invention act transversely to the axis of the workpiece and therefore also cannot be compared to those heretofore known methods wherein longitudinal vibrations are employed.

In accordance with another mode of the method of the invention, the oscillating grinding pressure is made up of a constant prestressing grinding pressure, and a simultaneous oscillating grinding pressure superimposed thereon.

In this connection, and further in accordance with the invention, the oscillating grinding pressure has an amplitude that is smaller than the magnitude of the prestressing pressure.

In accordance with yet another feature of the invention, determined by testing, the amplitude of the oscillating grinding pressure is substantially one-third of the magnitude of the prestressing pressure. The significance thereof if that the resulting grinding pressure is about twice as high at the maximum thereof than at the minimum thereof.

In accordance with an added mode of the method according to the invention, the amplitude of the oscillating grinding pressure is greater than the amplitude of the resonant vibration pressure exerted on the workpiece. Also in this mode of the method of the invention, the resonant vibrations are not caused to disappear. However, the effect thereof upon the condition of the surface and the roundness of the workpiece and the life of the grinding wheels is no longer discernible. In this mode of the method according to the invention, it is advantageous if the amplitude of the pressure oscillation is considerably greater than the amplitude of the resonant vibration pressure. More specifically, in accordance with the invention, the amplitude of the grinding pressure oscillations is substantially 2 to 15 times the amplitude of the resonant vibrations. It has been determined by the tests, in fact, that the amplitude of the grinding pressure oscillations is substantially 10 times as great as the amplitude of the resonant vibrations. The aforedescribed mode of the method of the invention also differs from the heretofore known method employing countervibrations, which was mentioned hereinbefore with respect to the amplitude of the oscillations in addition to the frequency.

In accordance with additional features of the method of the invention, the frequency of the pulsations or the pressure oscillations is between substantially 100 and substantially 500 Hz. It is particularly advantageous if the frequency is between 200 and 400 Hz. The tests that have been carried out indicate that a frequency of about 300 Hz is most advantageous. However, it is important here that the frequency of the oscillating grinding pressure has no coincidence with the frequency ranges of the resonant frequencies.

In accordance with another mode of the method of the invention, the oscillating frequency of the pulsations or of the oscillating grinding pressure is adjusted with respect to the frequency of rotation of the workpiece, which corresponds to the speed of rotation of the workpiece, and with respect to the frequency of rotation of the grinding wheel which corresponds to the speed of rotation of the grinding wheel, to an adjusted value that is other than an integral ratio or an inverse of the reciprocal of an integral ratio. In this manner, the most uniform distribution of the grinding action that is possible is obtained over the peripheral cylindrical surface of the workpiece and over the peripheral surface of the grinding wheel which contributes to the avoidance of undesirable markings.

In accordance with an added mode of the method of the invention, the oscillating frequency of the pulsations or of the grinding pressure oscillations is greater than the frequency of rotation of the workpiece, which corresponds to the rotary speed of the workpiece. In this manner, an equalized microstructure is obtained over the cylindrical peripheral surface of the workpiece.

In accordance with another mode of the method of the invention, the grinding pressure oscillations have a waveform that is substantially sinusoidal. This facilitates adjusting the frequency of the grinding pressure oscillations outside the frequency ranges of the resonant vibrations. If, in accordance with an alternate feature of the invention, grinding pressure oscillations are not sinusoidal, it is advisable that the harmonics be outside the frequency ranges of the resonant vibrations. This mode of the method of the invention, however, mainly relates to harmonics of appreciable amplitude only, to the extent that disturbances can be caused by them. In general, resonant vibrations are not sinusoidal, and it may be necessary to pay attention also to the harmonics, when practising the method of the invention.

In accordance with yet another feature of the method of the invention the hydraulic medium is pulsated to exert simultaneously at least two grinding pressure oscillations of different frequency. In some cases, further equalization of the grinding action can be achieved thereby.

In accordance with a further feature of the method according to the invention, the magnitude of the prestressing pressure and the frequency and amplitude of the grinding pressure oscillations are adjustable independently of one another. In this manner, the frequency can be adjusted or set outside the frequency ranges of the resonant vibrations. The prestressing pressure can furthermore be set according to the material of which the workpiece is formed and the desired material removal rate, as well as according to the material of which the grinding wheel is formed, the throughput velocity i.e. the rate of continuous travel of the workpiece, can also be taken into consideration. It is advantageous then to adjust the amplitude of the grinding pressure oscillations, likewise depending upon the specific conditions, so that it is larger than the amplitude of the resonant vibrations, but smaller than the magnitude of the prestressing pressure.

In accordance with yet a further feature of the invention, the pulsating of the hydraulic medium exert the oscillating grinding pressure at two locations substantially radially opposite one another on the cylindrical peripheral surface of the workpiece. In principle, two grinding wheels can be used in such a case, or one grinding wheel and one so-called control wheel. In either case, the pressure of the second wheel can be exerted as a counterpressure, or also a pressure oscillation can be imparted separately to the second wheel. A variation of the aforementioned mode of the method, may also be of interest in this connection, namely, working with at least two grinding pressure oscillations of different frequency.

In accordance with the device for carrying out the method of the invention for grinding elongated cylindrical workpieces in continuous operation as the workpieces are advanced while being rotated about the longitudinal axes thereof, there are provided guide means extending in longitudinal direction of a workpiece for guiding and supporting the workpiece, at least one grinding wheel adjacent the guide means and operable so as to apply prestressing grinding pressure transversely to the workpiece, means for mechanically supporting and feeding the grinding wheel toward the workpiece, an hydraulic cylinder connected to the mechanical supporting and feeding means for the grinding wheel, and means for generating pulsations in the hydraulic cylinder exerting an oscillating grinding pressure through the grinding wheel on the workpiece, the oscillating grinding pressure having a frequency that is outside the frequency ranges of resonant vibrations.

Operation with a hydraulic cylinder was found to be particularly advantageous. In principle, however, electromagnetic generation of oscillations or also a combination of electromagnetic oscillation generation with a hydraulic cylinder may also be considered for the same purpose, in accordance with the invention.

In accordance with another feature of the device according to the invention, the means for generating pulsations comprise a rotary piston valve, a pump and a pressure fluid tank, respectively connected to one another.

In accordance with a further feature of the invention, the device comprises means for setting a mean prestressing pressure in the hydraulic cylinder means for adjusting the speed of rotation of the rotary piston valve, and means for adjusting the amplitude of the oscillating grinding pressure exerted in the hydraulic cylinder.

Other features which are considered as characteristic for the invention are set forth in the appended claims.

Although the invention is illustrated and described herein as method and device for grinding elongated cylindrical workpieces which are advanced during the grinding operation while being rotated about the longitudinal axis thereof, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing in which:

FIG. 1 is a diagrammatic sectional view of one embodiment of the grinding apparatus for carrying out the method according to the invention;

FIG. 2 is a plot diagram of the time rate of change or waveform of the prestressing pressure, the grinding pressure oscillations and the resonant vibrations; and FIG. 3 is a diagrammatic sectional view of part of a somewhat different embodiment of the grinding apparatus of FIG. 1, also in accordance with the invention.

Referring now to the drawing, and first particularly to FIG. 1 thereof, there is shown, in accordance with the invention, an embodiment of a grinding apparatus which includes grinding wheels 1 and 2 mounted in bearing locations 3 and 4 on swinging or oscillating arms 5 and 6. The arms 5 and 6, in turn, are pivoted at respective points 7 and 8. At points 14 and 15, an hydraulic cylinder 16 and a piston 17 are linked articulatingly to the arms 5 and 6, respectively.

A workpiece 13 is guided by guide bars 11 and 12. It is set into rotation and advanced, for example, by a preceding or succeeding polishing machine.

The feed of the grinding wheels 1 and 2 is effected by feed means (spindles) 9 and 10.

The grinding pressure is exerted transversely to the longitudinal direction of the workpiece 13.

The following relates to the invention. A generator 32 of grinding pressure pulsation or oscillations is connected to the hydraulic cylinder 16 through an hydraulic line 18. The generator 32 is formed of a rotary piston valve 19, a pump 20 and a pressure fluid tank 21, respectively connected to one another.

The grinding pressure exerted on the workpiece 13 is shown in FIG. 2 in plot diagram form. The graph has a time axis 23 and a pressure axis 22. The mean grinding pressure or the penetrating pressure is represented by the broken line 24. The grinding pressure pulsations or oscillations 25 are superimposed thereon. Pressure, for example, exerted on the workpiece by the resonant vibrations is shown at 26. The pressures according to curves 24, 25 and 26 are to be considered as being superimposed. If the amplitude of waveform 26 is small by comparison e.g. 10 times as small as the amplitude of waveform 25, then the resonant vibrations according to curve 26 have no noticeable influence. The frequency of the waveform 25 must differ sufficiently from the frequency of the waveform 26. The amplitude of the grinding pressure oscillations 25 is advantageously substantially one-third of the magnitude of the constant mean prestressing pressure 24, as measured from the time axis 23.

The embodiment according to FIG. 3 operates with only one grinding wheel 27 and a control wheel 29. The workpiece 13 is guided by a guide bar 30. The drive wheel 29 sets the workpiece 13 in rotation and advances it. Feed of the grinding wheel 27 into the workpiece 13 is effected by a spindle 31. According to the invention, the grinding pressure oscillations 25, in addition to the prestressing pressure 24 (note FIG. 2) is applied to the illustrated support for the grinding wheel 27. The means for this purpose correspond to the means therefor according to FIG. 1.

Following is a test example. The test was carried out with the grinding apparatus according to the embodiment of FIG. 1 of the invention.

In the test, the workpiece material was a bar of 15 mm diameter of V2A Supra (Steel Code No. 1,4301), in accordance with German Engineering standards. The throughput velocity of the bar workpiece was 11 m/min.

The speed of rotation of the bar was 1,616 r.p.m.

The two grinding wheels had speeds of 2,350 and 2,285 r.p.m.

The reduction or material removal in one pass was 0.07 mm off the diameter of the bar.

The mean pressure in the line 18 and in the cylinder 16 was 30 atmospheres absolute or excess pressure.

The amplitude of oscillation of the points 14 and 15 relative to one another was ± 0.01 mm, i.e. the greatest distance of the points 14 and 15 from one another differed from the smallest distance therebetween by 0.02 mm. The amplitude of oscillation of the wheels 1 and 2 relative to one another was therefore ± 0.005 mm. The amplitude of oscillation of each grinding wheel was accordingly ± 0.0025 mm. Each grinding wheel therefore executed a total reciprocating movement of 0.005 mm between the locations at which the extreme maximum and the extreme minimum pressure were exerted against the workpiece 13.

The frequency was 285 Hz.

With this grinding procedure, a diameter difference, according to the ISA tolerance h6, of between 0 and 0.011 mm (in the average, about 6 μm) was obtained over a total length of 3 m. The maximum out-of-roundness was 0.5 μm.

The same values were achieved when grinding additional bars (total weight, about 450 kg), with only a conventional automatic readjustment of the grinding wheels, being applied in accordance with the wear.

As the tests showed, similar tolerance values were obtainable without employing the method according to the invention only with a throughput velocity of the workpiece that is at most half the velocity of throughput i.e. about 5 m/min. as that possible with the method of the invention.

I claim:

1. Method of grinding elongated, cylindrical workpieces in continuous operation in a grinding machine wherein the workpieces are advanced while they are rotated about the longitudinal axes thereof, which comprises exerting a pulsating grinding pressure transversely to the longitudinal axis of the workpiece and adjusting the frequency of the pulsations to lie substantially in low-to-medium frequency range outside the frequency ranges of resonant vibrations of parts of the workpiece and of the grinding machine.

2. Method according to claim 1 which comprises pulsating an hydraulic medium to exert said pulsating grinding pressure.

3. Method according to claim 1, wherein the pulsating grinding pressure is made up of a constant prestressing grinding pressure, and a simultaneous pulsating grinding pressure.

4. Method according to claim 3, wherein the pulsating grinding pressure has an amplitude that is smaller than the magnitude of the prestressing pressure.

5. Method according to claim 3, wherein the amplitude of the pulsating grinding pressure is substantially one-third of the magnitude of the prestressing pressure.

6. Method according to claim 3, wherein the amplitude of the pulsating grinding pressure is greater than the amplitude of the resonant vibration pressure exerted on the workpiece.

7. Method according to claim 6, wherein the amplitude of the pulsating grinding pressure is substantially 2 to 15 times as great as the amplitude of the resonant vibration pressure.

8. Method according to claim 6, wherein the amplitude of the pulsating grinding pressure is substantially 10 times as great as the amplitude of the resonant vibration pressure.

9. Method according to claim 1, wherein the pulsating frequency of the pulsating grinding pressure is between substantially 100 and substantially 500 Hz.

10. Method according to claim 1, wherein the pulsating frequency of the pulsating grinding pressure is adjusted with respect to the frequency of rotation of the workpiece, corresponding to the speed of rotation of the workpiece, and with respect to the frequency of rotation of the grinding wheel, corresponding to the speed of rotation of the grinding wheel, to an adjusted value that is other than an integral ratio and an inverse integral ratio.

11. Method according to claim 1, wherein the pulsating frequency of the pulsating grinding pressure is greater than the frequency of rotation of the workpiece which corresponds to rotary speed of the workpiece.

12. Method according to claim 1, wherein the pulsating grinding pressure has a waveform that is substantially sinusoidal.

13. Method according to claim 1, wherein the pulsating grinding pressure has a waveform other than sinusoidal and having harmonics that are outside the ranges of the resonant vibrations.

14. Method according to claim 2, wherein the hydraulic medium is pulsated to exert simultaneously at least two pulsating grinding pressures of different frequency on the workpiece.

15. Method according to claim 1, wherein the magnitude of the prestressing pressure and the frequency and amplitude of the pulsating grinding pressure are adjustable independently of one another.

16. Method according to claim 2, wherein the pulsating of the hydraulic medium exerts the pulsating grinding pressure at two locations substantially radially opposite one another on the cylindrical periphery of the workpiece.

* * * * *